US006812425B1

(12) United States Patent
Wong

(10) Patent No.: US 6,812,425 B1
(45) Date of Patent: Nov. 2, 2004

(54) LOCKING TRIGGER SWITCH MECHANISM

(75) Inventor: Kin Yu Wong, Chan Wan (HK)

(73) Assignee: Defond Components Limited, Chai Wan (HK)

( * ) Notice: Subject to any disclaimer, the term of this patent is extended or adjusted under 35 U.S.C. 154(b) by 0 days.

(21) Appl. No.: 10/718,679

(22) Filed: Nov. 24, 2003

(51) Int. Cl.[7] ..... H01H 13/02
(52) U.S. Cl. ..... 200/522; 200/43.17; 200/321; 200/332.2
(58) Field of Search ..... 200/43.16–43.21, 200/522, 318, 321, 322, 332.2, 334

(56) References Cited

U.S. PATENT DOCUMENTS 2,928,921 A * 3/1960 Cranmore ..... 200/509
2,947,840 A * 8/1960 Park et al. ..... 200/321
3,329,789 A * 7/1967 Sahrbacker ..... 200/522
3,777,092 A * 12/1973 Yeske ..... 200/337
3,829,645 A * 8/1974 Piber ..... 200/43.17
3,953,696 A * 4/1976 Reimann et al. ..... 200/522
4,180,716 A * 12/1979 Suzuki ..... 200/320
5,012,057 A * 4/1991 Inuyama ..... 200/522

* cited by examiner

*Primary Examiner*—Michael A. Friedhofer
(74) *Attorney, Agent, or Firm*—Leydig, Voit & Mayer, Ltd.

(57) ABSTRACT

A trigger mechanism for a power tool, comprises a chassis, a trigger mounted movably to the chassis, and an electrical switch mounted to the chassis and activated by movement of the trigger between ON and OFF positions to close and open an electrical circuit. A locking mechanism attached to the chassis is user-activated to unlock the trigger in the OFF position and trigger-activated to release the trigger in the ON position. The mechanism includes a single, spring-loaded locking pin arranged to lock the trigger in both the ON and the OFF positions.

14 Claims, 3 Drawing Sheets

11
16
31
25
29
21
14
11
27
25
16
26
15
17
22
32
28
33
16
27
11
26
21

11
26
21

26
21

26
21

LOCKING TRIGGER SWITCH MECHANISM

The present invention relates to an electric trigger switch of the type intended for use in a hand-held power tool such as an electric drill or rotary drive tool for example.

BACKGROUND OF THE INVENTION

More particularly, although not exclusively, the invention relates to an electric trigger switch with a locking mechanism enabling the trigger to be locked in ON and OFF positions.

It is known to provide locking mechanisms for power tool trigger switches. These mechanisms typically include a pushbutton enabling the trigger to be locked down in the ON position, so that there is no need for a user to keep pulling the trigger. Inadvertent depression of the trigger from the OFF position to the ON position presents a safety risk.

It is an object of the present invention to overcome or substantially ameliorate the above problem and/or more generally to provide an improved locking trigger switch for a power tool.

SUMMARY OF THE INVENTION

According to the invention, there is provided a trigger mechanism for a power tool, comprising a chassis, a trigger mounted to the chassis for movement between ON and OFF position, and an electrical switch mounted to the chassis for activation by movement of the trigger between the ON and OFF positions to close and open an electrical circuit. A locking mechanism attached to the chassis is included, that being user-activated to unlock the trigger in the OFF position and trigger-activated to release the trigger in the ON position.

Preferably, the trigger is mounted pivotally to the chassis.

More preferably, the trigger mechanism includes an activating rod extending from the trigger to the electrical switch.

In a preferred embodiment, the locking mechanism comprises a single locking member arranged to lock the trigger in both the ON and the OFF positions.

More preferably, the locking member comprises a locking pin extending through the trigger and the chassis.

Further more preferably, the locking mechanism includes a locking plate fixed to the trigger and having a slot through which the locking pin passes.

Yet further more preferably, the locking pin has a narrow shank portion and a wide shank portion, and the slot of the locking plate has a width through which the narrow shank portion can pass to permit movement of the trigger and a widening at one end through which the wide shank portion is engageable to lock the trigger in the OFF position.

It is preferred that the locking mechanism further includes a pushbutton secured to the locking pin and a spring co-acting between the pushbutton and the locking plate to bias the locking pin to lock the trigger in the OFF position and to release the trigger in the ON position.

It is further preferred that the locking pin has an end remote from the pushbutton, and the trigger has an aperture into which the head is engageable to lock the trigger in the ON position.

In a preferred embodiment, the locking mechanism includes a spring biassing the locking member to lock the trigger in the OFF position and to release the trigger in the ON position.

More preferably, the locking member comprises a locking pin extending through the trigger and the chassis, the trigger including a pair of opposed side walls embracing the chassis and through which a shank of the locking pin extends, the shank having an end engageable with one trigger wall to lock the trigger in the OFF position and an opposite end engageable with the other trigger wall to lock the trigger in the ON position.

In a specific construction, the electrical switch includes two pairs of terminals, each pair being for an individual electrical circuit that are openable and closable upon movement of the trigger.

BRIEF DESCRIPTION OF DRAWINGS

The invention will now be more particularly described, by way of example only, with reference to the accompanying drawings, in which:

FIG. 8, including

DETAIL DESCRIPTION OF PREFERRED EMBODIMENT

Figure 1:
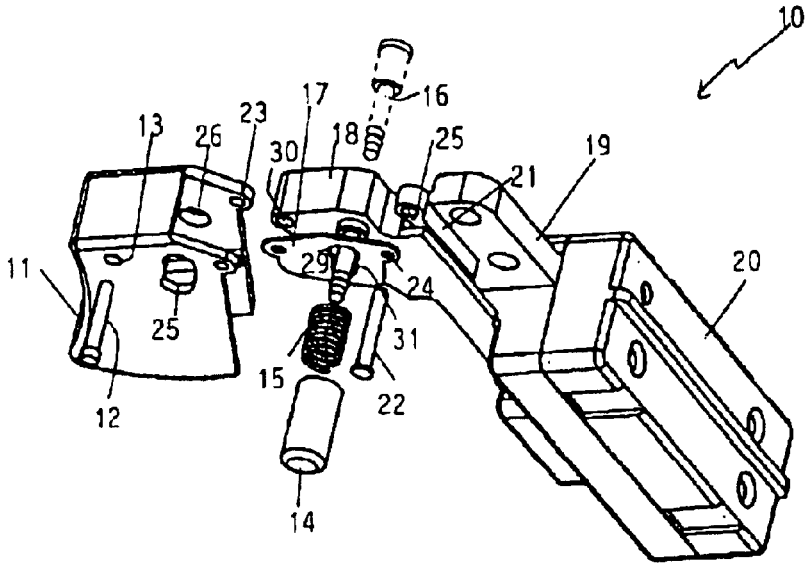
FIG. 1 is an exposed top and left side perspective view of an embodiment of a trigger mechanism in accordance with the invention.
Figure 2:
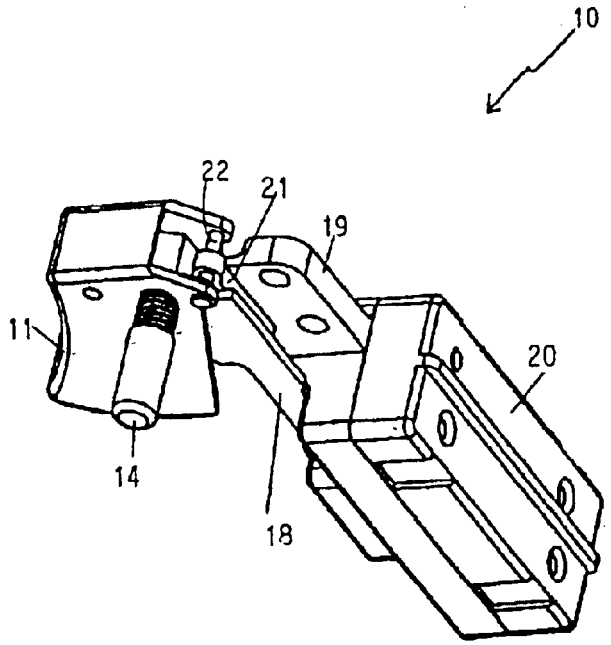
FIG. 2 is a top and left side perspective view of the trigger mechanism of FIG. 1 in the assembled condition.
Figure 3:
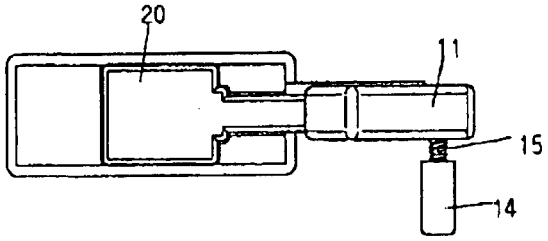
FIG. 3 is a front view of the trigger mechanism of FIG. 1, shown lying on the left side.
Figure 4:
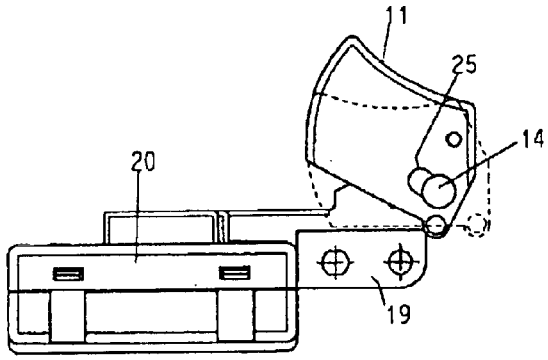
FIG. 4 is a left side view of the trigger mechanism of FIG. 3.
Figure 5:
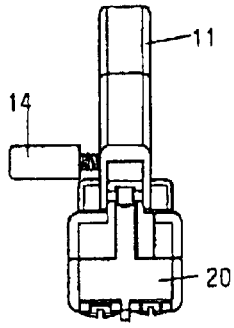
FIG. 5 is a top plan view the trigger mechanism of FIG. 3.
Figure 6:
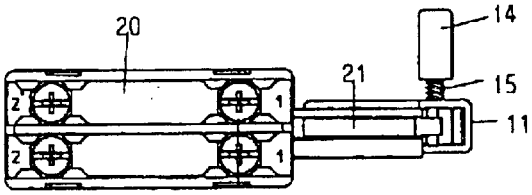
FIG. 6 is a rear view of the trigger mechanism of FIG. 3.

Referring to the drawings, there is shown a trigger mechanism 10 embodying the invention for a hand-held power tool such as an electric drill, grinder, sander, saw, grinder, rotary driving tool or any other power tool or electrical device of the type that includes a finger-activated pull trigger for switching on and off the tool or device.

The trigger mechanism 10 has a moulded plastics chassis 18 including a chassis mounting plate 19 having a pair of fixing apertures by which the chassis 18 is mounted internally of a power tool body nearby its handle. A switchbox 20 extends from the mounting plate 19 and is received within the handle of the power tool body. The mechanism 10 includes a spring-loaded plastics trigger 11 mounted pivotally to the chassis 18 by means of a metal pivot pin 12 that passes through small holes 13 and 30 in the trigger 11 and chassis 18.

The trigger 11 has a pair of opposed side walls embracing the chassis 18, to each of which there is formed a pinhole 23 for receiving an activating rod pin 22 that also passes through a middle pinhole 25 at one end of an activating rod 21. The rod 21 depends from the pin 22 into the switchbox 20. Upon pivoting of the trigger 11 about the pivot pin 12, the other pin 22 moves up and down to cause generally vertical longitudinal sliding movement of the activating rod 21 that in turn operates the switch within the switchbox 20. A locking mechanism is provided to prevent accidental depression or pulling of the trigger 11.

The locking mechanism comprises a locking pin 16 that extends laterally through the trigger 11 and through the chassis 18 and a metal locking plate 17 secured inside the trigger 11. One side wall of the trigger 11 has a curved aperture 25 that is superimposed upon a curved slot 31 of the locking plate 17. The curved slot 31 has a widening 29 at it upper end.

The locking pin 16 has a wide shank portion 27 and a narrow shank portion 32. The narrow shank portion 32 is sized to pass and passes freely through the slot 31 of the locking plate 17, whereas the wide shank portion 27 can only pass through the widening 29 of the metal slot 31.

The locking pin 16 includes a barbed end 33 that extends co-axially from the narrow shank portion 32 and is secured within an external plastics lock button 14. Also included is a wide flat head 28 at the outer end of the wide shank portion 27, which is sized to fit within an aperture 26 in the other side wall of the trigger 11 but be retained by the chassis 18 at a position behind the aperture 26.

Figures 8A, 8B, 8C, 8D, 9:
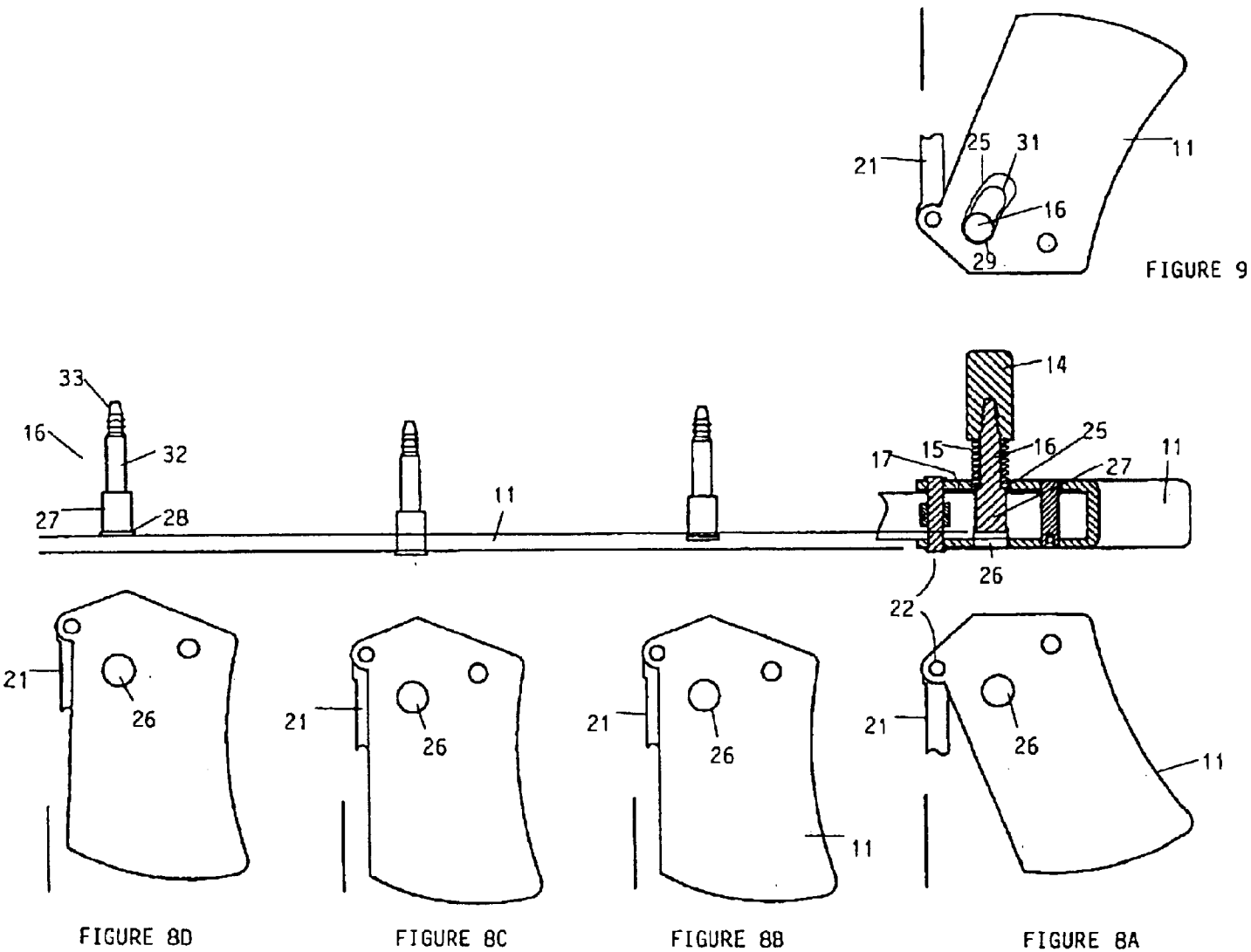
FIGS. 8A–8D, is a series of right side views that illustrate sequentially pulling of a trigger of the trigger mechanism of FIG. 1 at different stages.
FIG. 9 is a right side view of the trigger of FIG. 8.

Disposed around the narrow shank portion 32 is a compression coil spring 15 that co-acts between the lock button 14 and the locking plate 17, thereby biassing the locking pin 16 lengthwise outwards in the direction of the button 14. In the outermost position of the locking pin 16, the wide shank portion 27 has its inner end engaging within the widening 29 of metal slot 31, whereby the trigger mechanism 10 is locked normally in the OFF position (FIGS. 8A and 9).

In operation, the trigger 11 cannot be depressed by a user unless the lock button 14 is first pressed against the force of spring 15 to push the wide shank portion 27 out of the metal slot widening 29. Once the wide shank portion 27 is released from the locking plate 17, the trigger 11 can be pulled with both slots 25 and 31 passing over the narrow shank portion 32 until the trigger 11 is fully depressed (FIG. 8B).

Not until the trigger 11 is fully depressed, its wall aperture 26 comes into alignment with the locking pin head 28. At this condition, upon further pressing of the lock button 14, the head 28 fits into and through the aperture 26 to thereby lock the trigger 11 in the ON position (FIG. 8C).

There is a spring (not shown) inside the trigger 11 and bearing against the chassis 18 to bias the trigger 11 towards the OFF position. The force exerted by this spring maintains contact between the head 28 and aperture 26, overcoming the force exerted by the spring 15 on the locking pin 16. As a result, the trigger 11 is held in the ON position until such time as the trigger 11 is pressed momentarily inwards slightly. When the trigger 11 so moves, the force exerted by the coil spring 15 on the locking pin 16 retracts the head 28 from the aperture 26, thereby allowing the trigger 11 to self return to the OFF position.

Figure 7:
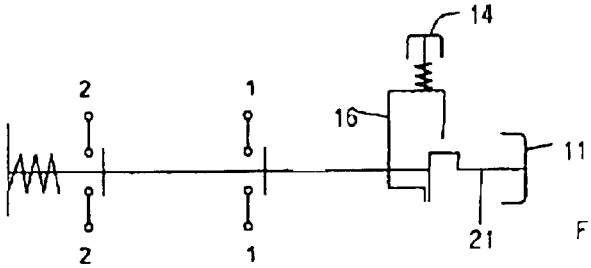
FIG. 7 is a schematic circuit diagram of the trigger mechanism and an associated switchbox of FIG. 6.

As depicted in FIG. 7, the switchbox 20 includes two pairs of electrical terminals 1 and 2. Each pair of these terminals defines an electrical switch that is operable by movement of the trigger 11 between the ON and OFF positions for closing and opening an individual electrical circuit. One such circuit includes an electric motor for driving the power tool, whilst the other circuit may be employed for an auxiliary electrical element such as a power-on indicator lamp.

The subject locking mechanism utilizes a single locking member or pin 16 that serves two functions, i.e. for locking the trigger 11 in both the ON and the OFF positions, making use of opposite ends of a portion of the locking pin 16. That is, one end of the wide shank portion 27 (adjoining the narrow shank portion 32) is engageable with one wall of the trigger 11 to lock it in the OFF position, whilst the opposite end (adjoining the head 28) is engageable with the other trigger wall to lock the trigger 11 in the ON position.

The invention has been given by way of example only, and various modifications and/or variations to the described embodiment may be made by persons skilled in the art without departing from the scope of the invention as specified in the accompanying claims. For example, the trigger might slide linearly, rather than pivot upon a pivot pin, in which case the curved slots could be replaced with linear slots and the activating rod might extend in the direction of movement of the trigger.

What is claimed is:

1. A trigger mechanism for a power tool, comprising:

a chassis;

a trigger mounted to the chassis for movement between an ON and an OFF position, wherein the trigger is mounted pivotally to the chassis;

an electrical switch mounted to the chassis for activation by movement of the trigger between the ON and OFF positions to close and open an electrical circuit; and a locking mechanism attached to the chassis, the locking mechanism being user-activated to unlock the trigger in the OFF position and trigger-activated to release the trigger in the ON position.

2. The trigger mechanism as claimed in claim 1, including an activating rod extending from the trigger to the electrical switch.

3. The trigger mechanism as claimed in claim 1, wherein the locking mechanism comprises a single locking member arranged to lock the trigger in both the ON and the OFF positions.

4. The trigger mechanism as claimed in claim 3, wherein the locking member comprises a locking pin extending through the trigger and the chassis.

5. The trigger mechanism as claimed in claim 4, wherein the locking mechanism includes a locking plate fixed to the trigger and having a slot through which the locking pin passes.

6. The trigger mechanism as claimed in claim 5, wherein the locking pin has a narrow shank portion and a wide shank portion, and the slot of the locking plate has a width through which the narrow shank portion can pass to permit movement of the trigger and a widening at one end through which the wide shank portion is engageable to lock the trigger in the OFF position.

7. The trigger mechanism as claimed in claim 5, wherein the locking mechanism further includes a pushbutton secured to the locking pin and a spring co-acting between the pushbutton and the locking plate to bias the locking pin to lock the trigger in the OFF position and to release the trigger in the ON position.

8. The trigger mechanism as claimed in claim 7, wherein has an end remote from the pushbutton, and the trigger has an aperture into which the head is engageable to lock the trigger in the ON position.

9. The trigger mechanism as claimed in claim 3, wherein the locking mechanism includes a spring biassing the locking member to lock the trigger in the OFF position and to release the trigger in the ON position.

10. The trigger mechanism as claimed in claim 9, wherein the locking member comprises a locking pin extending through the trigger and the chassis, the trigger including a pair of opposed side walls embracing the chassis and through which a shank of the locking pin extends, the shank having an end engageable with one trigger wall to lock the trigger in the OFF position and an opposite end engageable with the other trigger wall to lock the trigger in the ON position.

11. The trigger mechanism as claimed in claim 1, wherein the electrical switch includes two pairs of terminals, each pair being for an individual electrical circuit that are openable and closable upon movement of the trigger.

12. A trigger mechanism for a power tool, comprising:

a chassis;

a trigger mounted to the chassis for movement between an ON and an OFF position;

an electrical switch mounted to the chassis for activation by movement of the trigger between the ON and OFF positions to close and open an electrical circuit; and a locking mechanism attached to the chassis, the locking mechanism being user-activated to unlock the trigger in the OFF position and trigger-activated to release the trigger in the ON position;

wherein the locking mechanism comprises:

a single locking member arranged to lock the trigger in both the ON and the OFF positions, wherein the locking member comprises a locking pin extending through the trigger and the chassis, the trigger including a pair of opposed side walls embracing the chassis and through which a shank of the locking pin extends, the shank having an end engageable with one trigger wall to lock the trigger in the OFF position and an opposite end engageable with the other trigger wall to lock the trigger in the ON position; and a spring biassing the locking member to lock the trigger in the OFF position and to release the trigger in the ON position.

13. A trigger mechanism for a power tool, comprising:

a chassis;

a trigger mounted to the chassis for movement between an ON and an OFF position;

an electrical switch mounted to the chassis for activation by movement of the trigger between the ON and OFF positions to close and open an electrical circuit; and a locking mechanism attached to the chassis, the locking mechanism being user-activated to unlock the trigger in the OFF position and trigger-activated to release the trigger in the ON position;

wherein the locking mechanism comprises:

a single locking member arranged to lock the trigger in both the ON and the OFF positions, wherein the locking member comprises a locking pin extending through the trigger and the chassis; and a locking plate fixed to the trigger and having a slot through which the locking pin passes, wherein the locking pin has a narrow shank portion and a wide shank portion, and the slot of the locking plate has a width through which the narrow shank portion can pass to permit movement of the trigger and a widening at one end through which the wide shank portion is engageable to lock the trigger in the OFF position.

14. A trigger mechanism for a power tool, comprising:

a chassis;

a trigger mounted to the chassis for movement between an ON and an OFF position;

an electrical switch mounted to the chassis for activation by movement of the trigger between the ON and OFF positions to close and open an electrical circuit; and a locking mechanism attached to the chassis, the locking mechanism being user-activated to unlock the trigger in the OFF position and trigger-activated to release the trigger in the ON position;

wherein the locking mechanism comprises:

a single locking member arranged to lock the trigger in both the ON and the OFF positions, wherein the licking member comprises a locking pin extending through the trigger and the chassis;

a locking plate fixed to the trigger and having a slot through which the locking pin passes; and a pushbutton secured to the locking pin and a spring co-acting between the pushbutton and the locking plate to bias the locking pin to lock the trigger in the OFF position and to release the trigger in the ON position.

* * * * *